US007171362B2

(12) United States Patent
Hain

(10) Patent No.: US 7,171,362 B2
(45) Date of Patent: Jan. 30, 2007

(54) ASSIGNMENT OF PHONEMES TO THE GRAPHEMES PRODUCING THEM

(75) Inventor: Horst-Udo Hain, Munich (DE)

(73) Assignee: Siemens Aktiengesellschaft, Munich (DE)

( * ) Notice: Subject to any disclaimer, the term of this patent is extended or adjusted under 35 U.S.C. 154(b) by 508 days.

(21) Appl. No.: 09/943,091

(22) Filed: Aug. 31, 2001

(65) Prior Publication Data

US 2002/0049591 A1 Apr. 25, 2002

(30) Foreign Application Priority Data

Aug. 31, 2000 (DE) ..... 100 42 943

(51) Int. Cl.
*G10L 13/00* (2006.01)
*G10L 13/06* (2006.01)
*G10L 15/12* (2006.01)

(52) U.S. Cl. ..... 704/267; 704/266; 704/241

(58) Field of Classification Search ..... 704/258–269, 704/241

See application file for complete search history.

(56) References Cited

U.S. PATENT DOCUMENTS

| | | | | |
|---|---|---|---|---|
| 4,384,273 | A | 5/1983 | Ackland et al. | |
| 5,732,388 | A | 3/1998 | Hoege et al. | |
| 6,029,135 | A | 2/2000 | Krasle | |
| 6,076,059 | A * | 6/2000 | Glickman et al. | 704/260 |
| 6,094,633 | A | 7/2000 | Gaved et al. | |
| 6,212,500 | B1 | 4/2001 | Kohler | |
| 6,236,965 | B1 * | 5/2001 | Kim et al. | 704/254 |
| 6,363,342 | B2 * | 3/2002 | Shaw et al. | 704/220 |
| 6,411,932 | B1 * | 6/2002 | Molnar et al. | 704/260 |

FOREIGN PATENT DOCUMENTS

| | | |
|---|---|---|
| DE | 19636739 C1 | 7/1997 |
| DE | 19719381 C1 | 1/1998 |
| DE | 69420955 T2 | 7/2000 |
| WO | WO 94/23423 | 10/1994 |

OTHER PUBLICATIONS

"Dynamic programming algorithm optimization for spoken word recognition", Sakoe, H.; Chiba, S., Acoustics, Speech, and Signal Processing, IEEE Transactions on, vol. 26, Iss. 1, Feb. 1978, pp. 43-49.*

Luk et al., "Inference of letter-phoneme correspondences with pre-defined consonant and vowel patterns", ICASSP-93, vol. 2, 27-30, Apr. 1993, pp. 203-206.*

Luk et al., "A Novel Approach to Inferring Letter-Phoneme Correspondences", Speech Processing 2, VLSI, Underwater Signal Processing, Toronto, May 14-17, 1991, International Conference on Acoustics, Speech & Signal Processing, ICASSP, New York, IEEE, US, vol. 2, Conf. 16, Apr. 14, 1991, pp. 741-744, XP010043082, ISBN: 0-7803-0003-3.

(Continued)

*Primary Examiner*—David Hudspeth
*Assistant Examiner*—Brian L. Albertalli
(74) *Attorney, Agent, or Firm*—Staas & Halsey LLP

(57) ABSTRACT

The assignment of phonemes to graphemes producing them in a lexicon having words (grapheme sequences) and their associated phonetic transcription (phoneme sequences) for the preparation of patterns for training neural networks for the purpose of grapheme-phoneme conversion is carried out with the aid of a variant of dynamic programming which is known as dynamic time warping (DTW).

11 Claims, 4 Drawing Sheets

OTHER PUBLICATIONS

Nakagawa, "Speaker-Independent Consonant Recognition in Continuous Speech by a Stochastic Dynamic Time Warping Method", Eighth International Conference on Pattern Recognition, Proceedings (CAT. No. 86CH2342-4), Paris, France, Oct. 27-31, 1986, pp. 925-928, XP008012464, 1986 Washington, DC, USA, IEEE Compt. Soc. Press, USA, ISBN: 0-8186-0742-4.

Kruskal et al., "An Anthology of Algorithms and Concepts for Sequence Comparison", Time Warps, String Edits and Macromolecules: The Theory and Practice of Sequence Comparison, Addison-Wesley Publishing Co., Amsterdam, NL, pp. 265-310, XP000570580.

Besling, "A Statistical Approach to Multilingual Phonetic Transcription", Philips Journal of Research, Elsevier, Amsterdam, NL, vol. 49, No. 4, 1995, pp. 367-379, XP004000261, ISSN: 0165-5817.

Luk et al., "Inference of Letter-Phoneme Correspondences by Delimiting and Dynamic Time Warping Techniques", Digital Signal Processing 2, Estimation, VLSI. San Francisco, Mar. 23-26, 1992, Proceedings of the International Conference on Acoustics, Speech and Signal Processing (ICASSP), New Yourk, IEEE, US, vol. 5 Conf. 17, Mar. 23, 1992, pp. 61-64, XP010058860, ISBN: 0-7803-0532-9.

Hoffmann, "signalanayse und-erkennung," Springer Verlag, Berlin, Heidelberg, 1998, pp. 380-404.

Rabiner et al., "Fundamentals of Speech Recognition," Englewood Cliffs, Prentice Hall 1993 (Prentice Hall Signal Processing Series), pp. 200-241.

Stefan Besling, "Heuristical and Statistical Methods for Grapheme-to-Phoneme Conversion," Proceedings KONVENS 94, Wien, pp. 23-31.

* cited by examiner

FIG 4

| | | | | | |
|---|---|---|---|---|---|
| n | **0** | 0.013 | 0.949 | 0 | **1** |
| e | 0 | 0 | 0 | 0.986 | 0 |
| n | 0 | 0.013 | 0.949 | 0 | 0.949 |
| n | 0 | 0.013 | 0.949 | 0 | 0.949 |
| ö | 0 | 0.920 | 0 | 0 | 0 |
| k | **1** | 0 | 0 | 0 | **0** |
| | k | 9 | n | @ | n |

FIG 5

| | | | | | |
|---|---|---|---|---|---|
| n | **0** | 0 | 0 | 0 | **0.817** |
| e | 0 | 0 | 0 | 0.817 | 0 |
| n | 0 | 0.000 | 0.828 | 0 | 0 |
| n | 0 | 0.012 | 0.873 | 0 | 0 |
| ö | 0 | 0.920 | 0 | 0 | 0 |
| k | **1** | 0 | 0 | 0 | **0** |
| | k | 9 | n | @ | n |

FIG 6A

| | j | i: | l | d |
|---|---|---|---|---|
| d | 0 | 0 | 0 | 0.01 |
| l | 0 | 0 | 0.01 | 0 |
| e | 0.00 | 0.01 | 0.00 | 0 |
| i | 0.04 | 0.03 | 0 | 0 |
| y | 1.0 | 0.00 | 0 | 0 |

FIG 6B

| | j | i: | l | d |
|---|---|---|---|---|
| d | 0 | 0 | 0 | 0.01 |
| l | 0 | 0 | 0.01 | 0 |
| e | 0.00 | 0.01 | 0.00 | 0 |
| i | 0.04 | 0.03 | 0 | 0 |
| y | 1.0 | 0.00 | 0 | 0 |

ASSIGNMENT OF PHONEMES TO THE GRAPHEMES PRODUCING THEM

CROSS REFERENCE TO RELATED APPLICATIONS

This application is based on and hereby claims priority to German Application No. 10042943.2 filed on Aug. 31, 2000 in Germany, the contents of which are hereby incorporated by reference.

BACKGROUND OF THE INVENTION

The invention relates to a method, a computer program product, a data medium and a computer system for the assignment of phonemes to the graphemes producing them in a lexicon having words (grapheme sequences) and their associated phonetic transcription (phoneme sequences).

Speech processing methods are disclosed, for example, in U.S. Pat. No. 6,029,135, U.S. Pat. No. 5,732,388, DE 19636739 C1 and DE 19719381 C1. Routines for grapheme-phoneme conversion, that is to say for converting written words into spoken sounds, are required for automatically reading aloud or extending the vocabulary of dictation systems or of automatic speech recognition systems. Neural networks are frequently used for this purpose.

The training of these neural networks is performed with the aid of patterns. A pattern includes of a number of letters from a word which are applied to the input nodes of a neural network, and of the associated phoneme corresponding to the output node. Each phoneme is frequently also assigned what is termed a grouping value. The grouping value specifies the number of graphemes which produce the associated phoneme.

The patterns are obtained from what are termed training lexica. A training lexicon contains assignments of graphemes, as a rule words, numerals, etc., that is to say everything which is to be converted, to phonemes and phoneme sequences, that is to say grapheme-phoneme transcriptions at the level of words. The phoneme sequences are produced in the training lexicon by a suitable type of phonetic transcription. SAMPA phonetic transcriptions or Spicos inventory, which are based on ASCII characters, are frequently used in the field of automatic speech recognition. A few German words may be listed by way of example with the associated phonetic transcription in SAMPA:

| | |
|---|---|
| Quatsch | kv'atS |
| spät | SpE:t |
| Schutz | SUts |
| schwer | Sve:6 |
| Sprache | Spra:x@ |

The sound "sch" is represented, for example, by [S], lengthenings by a colon. In this case, phonemes are represented in square brackets [ ], graphemes in pointed brackets < >. All the examples of phonetic transcription in the description are reproduced in SAMPA.

Although these training lexica include the phonetic transcription, they do not include the unique assignment of phonemes and the graphemes producing them, as required for the patterns. For example, the following assignment would be desirable for the word <Sprache>:

| | | | | | | | |
|---|---|---|---|---|---|---|---|
| Graphemes | S | p | r | a | c | h | e |
| Phonemes | S, 1 | p, 1 | r, 1 | a:, 1 | x, 2 | | @, 1 |

from which it is easier to derive the patterns for training the neural network. In the case of an input window with 7 letters, the following 6 patterns are yielded directly from the unique assignment:

| | | | | | | | |
|---|---|---|---|---|---|---|---|
| 1st | Input | | | S | p | r | a |
| Pattern | Output | | | S, 1 | | | |

The grapheme sequence of 3 empty characters, <S>, <p>, <r> and <a>, <S> being located centrally in the input window, is assigned to the sound [S] with the grouping value 1. The following are obtained correspondingly as further patterns:

| | | | | | | | | |
|---|---|---|---|---|---|---|---|---|
| 2nd | Input | | | S | p | r | a | c |
| Pattern | Output | | | | p, 1 | | | |
| 3rd | Input | | S | p | r | a | c | h |
| Pattern | Output | | | | r, 1 | | | |
| 4th | Input | S | p | r | a | c | h | e |
| Pattern | Output | | | | a:, 1 | | | |
| 5th | Input | p | r | a | c | h | e | |
| Pattern | Output | | | | x, 2 | | | |

The "Ach" sound, or voiceless velar fricative "ch" is assigned a grouping value of 2 in accordance with the segmentation rules, since it is assigned the two letters <c> and <h>. The letter window can therefore be displaced in the following pattern by 2 letters:

| | | | | | | | | |
|---|---|---|---|---|---|---|---|---|
| 6th | Input | a | c | h | e | | | |
| Pattern | Output | | | | @, 1 | | | |

The assignment of letters to phonemes is not, however, yielded uniquely from the phonetic transcription of the lexicon. The word <Sprache> has of 7 letters, but only of 6 phonemes. The question arises as to which of the phonemes is produced by 2 letters. Since also 2 phonemes can be produced by one letter, for example [ks] by <x>, the uncertainty in the grapheme-phoneme assignment is a general problem for the patterns.

To date, the grapheme-phoneme assignment has been carried out semi-automatically, starting from empirical rules evident to a native speaker, but this is subject to error, particularly in the case of multilingual systems, and constitutes a substantial outlay.

SUMMARY OF THE INVENTION

It is an object of one aspect of the invention automatically to produce the assignment of phonemes to the graphemes producing them for patterns for training a neural network for grapheme-phoneme conversion.

In this case, in the context of a computer program product the computer program is understood as a suitable product in whatever form, for example on paper, on a machine-readable data medium, distributed over a network, etc.

According to one aspect of the invention, the assignment of phonemes to the graphemes producing them is carried out in a lexicon having words (grapheme sequences) and their associated phonetic transcription (phoneme sequences) with the aid of a dynamic time warping (DTW) algorithm.

DTW algorithms are a variant of dynamic programming. They are described, for example, in:

1. Hoffmann, R.: "Signalanalyse und -erkennung" (Signal analysis and recognition.), Springer Verlag, Berlin, Heidelberg, 1998, pages 390–393.
2. Rabiner, L. R.; Juang, B. -H.: "Fundamentals of speech recognition." Englewood Cliffs: Prentice Hall 1993 (Prentice Hall Signal Processing Series).
3. Besling, S.: "Heuristical and Statistical methods of Grapheme-to-Phoneme Conversion"; Proceedings KONVENS 94, Vienna, pages 23–31.

It is preferred to select in a first step words in which the number of the graphemes and the number of the phonemes coincide. In these words, the graphemes and phonemes are assigned to one another in the sequence of the specification of their graphemes and phonemes in the lexicon. The relative frequency with which a phoneme is produced by a grapheme is determined from these assignments. Alternatively, it is also possible to determine the relative frequency with which a grapheme is assigned to a phoneme.

Created in a second step for each word of the lexicon is a two-dimensional matrix, the so-called incidence matrix, one index of which is given by the grapheme of the word, and the second index of which is given by the phoneme of the word. The relative frequencies belonging to the respective phoneme-grapheme pair and determined in the first step are selected as entries of the matrix.

In a third step, each matrix entry is logically combined by a mathematical operation, in particular a multiplication, with the extreme value, which is preferably the maximum value, of the following three preceding matrix entries: the entry for the same phoneme and the preceding grapheme in the word, the entry for the preceding phoneme and the same grapheme in the word, and the entry for the preceding phoneme and the preceding grapheme in the word. Other computing operations are also conceivable instead of multiplication, for example addition of the reciprocals of the matrix entries, or other operations successful in dynamic programming.

The first grapheme and the first phoneme of the word are the starting point in the multiplication operation, the modified entries of the matrix respectively yielded from the multiplication operations being used in determining the maximal values. A step direction is determined for this matrix entry by determining which of the three preceding matrix entries was extreme.

In a fourth step, the step direction determined for the matrix entry is respectively defined, starting from the matrix entry for the last phoneme and the last grapheme, along a path through the matrix up to the matrix entry for the first phoneme and the first grapheme. The matrix elements belonging to the path define the assignment of graphemes to phonemes of the word.

The lexicon is therefore consistently prepared. The method according to one aspect of the invention can be adapted for producing patterns for training neural networks.

After execution of the assignment of graphemes to phonemes for each word of the lexicon, these assignments are used to determine the position-dependent relative frequency with which a phoneme is produced by two or more graphemes, or two or more phonemes are produced by a grapheme, or two or more graphemes are assigned to a phoneme, or a grapheme is assigned to two or more phonemes. This permits corrections to be undertaken to the assignments in a further step.

These corrected assignments can be used for iterative improvements of the relative frequencies and thus of the assignments. For this purpose, after the correction of the assignments, the position-dependent relative frequencies are determined anew for each word of the lexicon from these corrected assignments. These are used in further assignments.

When determining the relative frequencies, it is advantageous to take into account only those assignments in which the matrix entry for the last phoneme and the last grapheme exceeds a prescribed threshold value after execution of the multiplications. This filters out long words in the case of which the assignment is uncertain, as well as very rare and therefore uncertain assignments.

It is advantageous to use unique entry knowledge for the matrix entries in order to create stable fixed points. Thus, for example, the matrix entry for the first phoneme and the first grapheme of each word is set to 1, like the matrix entry for the last phoneme and the last grapheme of each word. These two entries form the starting point and finishing point, respectively, of the path to be determined, and must be traversed in any case. On the other hand, the matrix entry for the first phoneme and the last grapheme of each word, as well as the matrix entry for the last phoneme and the first grapheme of each word are set to 0, because these assignments are basically ruled out.

The diagonal is preferred as the most likely path when determining the maximum in conjunction with the multiplication. That is to say, if in the determination of the maximum value of the three preceding matrix entries the matrix entry for the preceding phoneme and the preceding grapheme in the word and one of the other two entries are of equal magnitude, the matrix entry for the preceding phoneme and the preceding grapheme in the word is regarded as a maximum.

BRIEF DESCRIPTION OF THE DRAWINGS

These and other objects and advantages of the present invention will become more apparent and more readily appreciated from the following description of the preferred embodiments, taken in conjunction with the accompanying drawings of which:

FIG. 4 shows the matrix of the transition frequencies for the assignment of graphemes and phonemes for the word <können>;

FIG. 5 shows the matrix in accordance with FIG. 4 after execution of multiplications; and FIG. 6A shows a matrix in accordance with FIG. 5 for the word <yield>; and FIG. 6B shows the matrix in accordance with FIG. 6A after a correction of the assignment of graphemes and phonemes.

DETAILED DESCRIPTION OF THE PREFERRED EMBODIMENT

Figure 1:
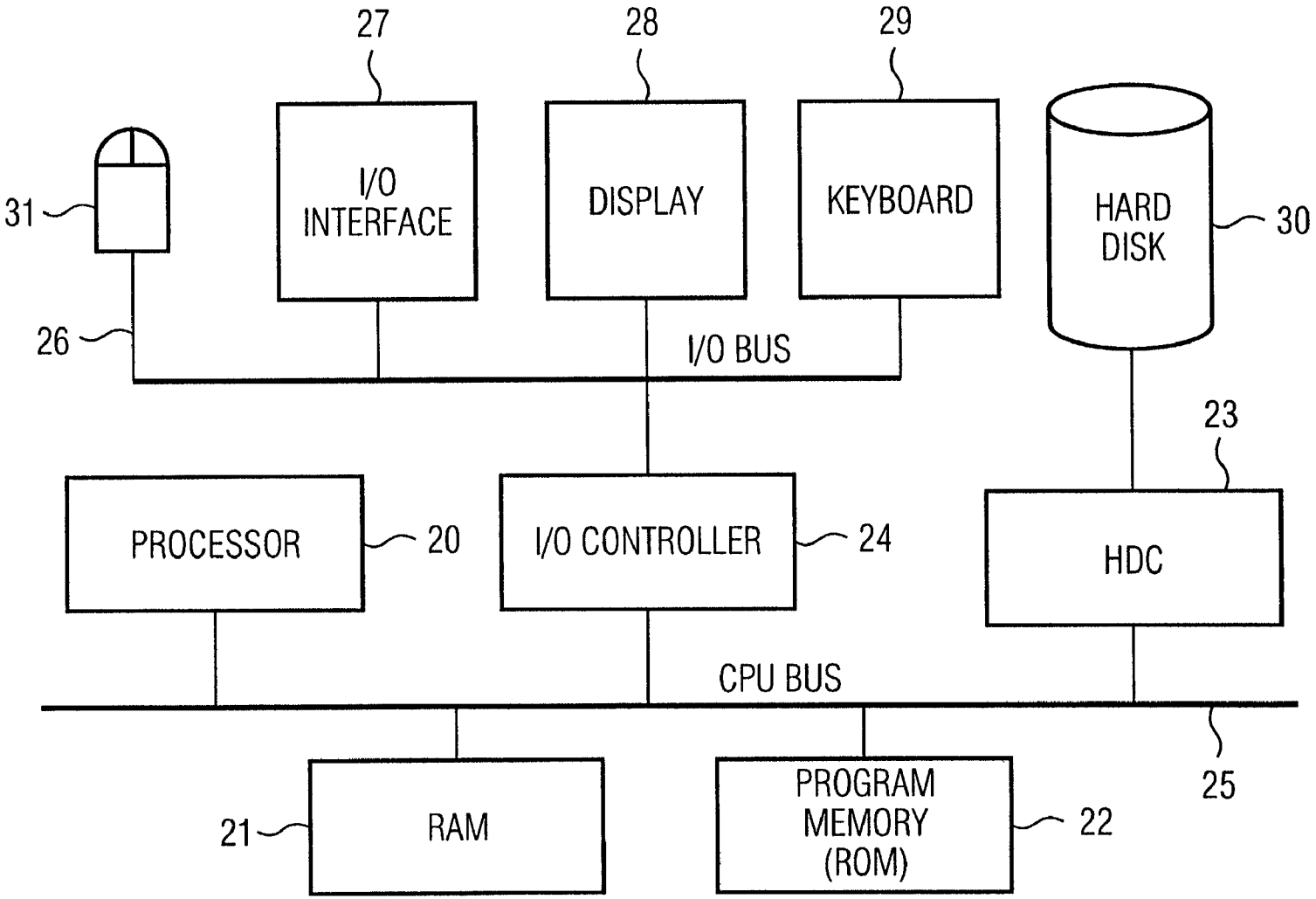
FIG. 1 shows a computer system suitable for assigning phonemes to the graphemes producing them in a lexicon.

Reference will now be made in detail to the preferred embodiments of the present invention, examples of which are illustrated in the accompanying drawings, wherein like reference numerals refer to like elements throughout.

FIG. 1 shows a computer system suitable for assigning phonemes to the graphemes producing them. This system has a processor (CPU) 20, a main memory (RAM) 21, a program memory (ROM) 22, a hard disk controller (HDC) 23, which controls a hard disk (30), and an interface controller (I/O controller) 24. The processor 20, main memory 21, program memory 32, hard disk controller 23 and interface controller 24 are coupled with one another via a bus, the CPU bus 25, for exchanging data and commands. The computer also has an input/output bus (I/O bus) 26, which couples various input and output devices to the interface controller 24. The input and output devices include, for example, a general input and output interface (I/O interface) 27, a display 28, a keyboard 29 and a mouse 31.

It is described below how the assignment of phonemes to graphemes producing them is carried out for a word.

Various relative frequencies for calculating the best assignment are used in the following description, and are generally denoted below briefly as frequencies. The frequency with which the grapheme g is assigned to the phoneme p is also termed the transitional frequency and is calculated from $$H(g \rightarrow p) = \frac{Z(g \rightarrow p)}{N(p)}$$

In this case, Z(g->p) is the number of assignments of the grapheme g, denoted below by <g>, the phoneme p, denoted below by [p], and N(p) is the number of all the assignments of all the graphemes to this phoneme [p].

Further frequencies are also required, since the relative frequency of the direct assignment of a grapheme to a phoneme is not sufficient for a final decision on the assignments. Consequently, position-dependent frequencies are also determined in grapheme groups <G>, as are the predecessor and successor frequencies which reflect the dependencies of the assignment to phonemes of the preceding and succeeding graphemes.

Position-dependent frequency $H^{pos}$ is understood as the frequency with which the grapheme at a specific position within a grapheme group <G> is assigned to a phoneme. Thus, for example, in the assignment of the grapheme group <ch> to the phoneme [C], the grapheme <c> is located at the first position, and the grapheme <h> at the second one. In this case, [C] is the voiceless palatal fricative or "Ich" sound, as in <Sicht>.

The frequency Hpos is calculated from $$H^{pos}(g \rightarrow p \mid g \text{ in } < G > \text{at } Pos\ i) = \frac{Z(g \rightarrow p \mid g \text{ in } < G > \text{ at } Pos\ i)}{N(p)}$$

Figure 2:
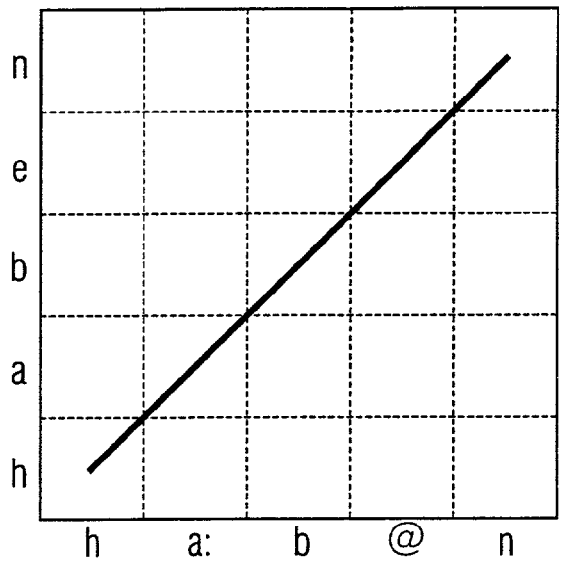
FIG. 2 shows a matrix with a 1-to-1 assignment of graphemes and phonemes for the word <haben>.

The transitional frequencies are initialized by using the entries in a lexicon with words and their phonetic transcription, in the case of which the number of the graphemes coincides with the number of the phonemes. It is assumed that each grapheme is assigned to the corresponding phoneme. This is illustrated in FIG. 2 by the diagonally extending line.

Figure 3:
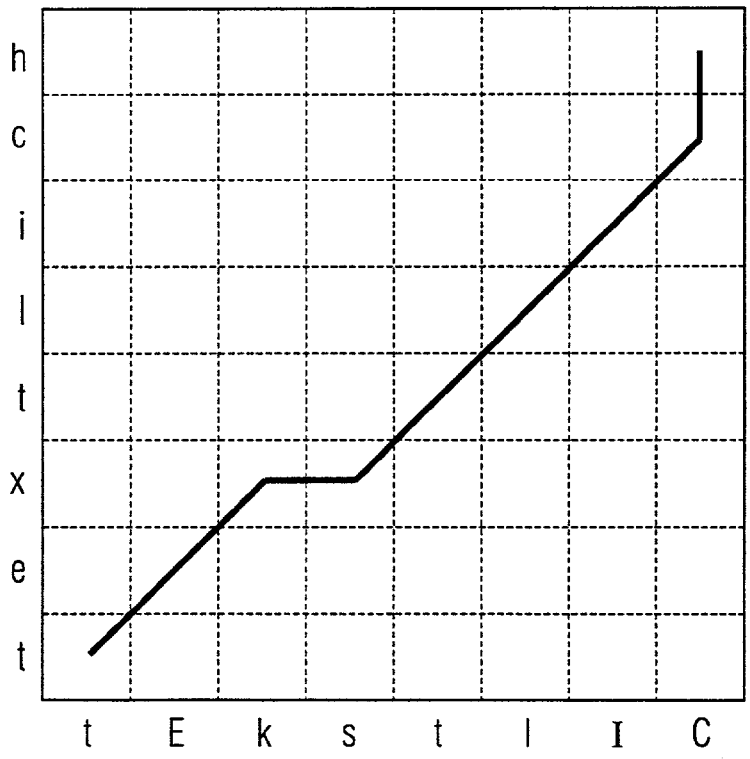
FIG. 3 shows a matrix for assigning graphemes and phonemes for the word <textlich>.

This direct assignment is not always correct, as is shown, for example, by the example of <textlich> from FIG. 3, in which the line for the assignments does not extend simply diagonally. The number of the graphemes in the word <textlich> coincides with the number of the phonemes. There are 8 in each case. However, the letter <x> is mapped onto two phonemes [ks], and the letter group <ch> is mapped onto only one phoneme [C]. since such exceptions occur relatively seldom, however, they are of a correspondingly low weighting in the application of the relative frequencies. Moreover, all the frequencies which undershoot a specific threshold value are removed in a later correction step.

The assignments are counted, and the relative frequencies or transitional frequencies are determined from them.

The relative frequencies or transitional frequencies obtained in the preceding step are used to set up a matrix with transitional frequencies for each word in the lexicon, as is shown in FIG. 4 for the word <können>.

Four entries are permanently prescribed in this case. The entries at bottom left and top right must always be traversed, since they are the starting point and finishing point, respectively. They are therefore set to 1. By contrast, the fields at top left and bottom right can never be traversed. They are therefore set to 0. All other fields contain the corresponding transitional frequencies H(g->p).

In this initial assignment, <n> is assigned to the phoneme [9] (rounded half-open front vowel "ö"). Consequently 0.013 is set instead of numeral 0 in the corresponding fields. However, it may be seen that this frequency is much lower than the remaining frequencies. It is therefore of virtually no importance.

The individual matrix entries are now multiplied in each case by the maximum of the adjacent entries in order to calculate the path. Since only the movements upward, to the right or upward to the right are permitted, only the values on the left, at the bottom and at bottom left starting from the respective matrix entry are considered for determining the maximum.

If during the determination of the maximum value the matrix entry at bottom left (diagonally) starting from the respective matrix entry and one of the other two entries are of equal magnitude, the diagonally situated matrix entry is regarded as maximal.

The multiplication begins with the first entry at bottom left, use being made in the determination of the maximum values of the modified entries of the matrix respectively resulting from the multiplications.

The first column and the lowermost row represent special cases, since there is no left-hand or lower neighbor. Here, the current entry is always multiplied by the lower or left-hand entry. The individual products resulting are illustrated in FIG. 5.

The accumulated frequency at the final point at top right is therefore the product of the entries or frequencies on the optimal path from the starting point to the finishing point.

A step direction from matrix entry to matrix entry is determined by determining which of the three preceding matrix entries was maximal. Starting from the matrix entry for the last phoneme and the last grapheme (top right), a path is respectively defined through the matrix along the determined step direction up to the matrix entry at bottom left. The matrix elements belonging to the path define the assignment of graphemes to phonemes of the word.

Subsequently, post-treatment is carried out for further improvement. The post-treatment serves to check the decisions made, taking account of the grapheme context and phoneme context.

Firstly, after execution of the described assignment of graphemes to phonemes for each word of the lexicon, these assignments are used to determine the relative frequency with which a phoneme is produced by two or more graphemes, or two or more phonemes are produced by a grapheme, that is to say the position-dependent frequency Hpos.

Subsequently, the assignment of graphemes to phonemes within a word is corrected with the aid of the position-dependent frequencies. Consideration is given for this purpose to FIG. 6A which corresponds in structure to FIG. 5. The previously described method supplies, for example, for the English word <yield>, the assignment yi e l d
to j i: l d since the frequency of the assignment of the grapheme <i> to the phoneme [j] is higher (here 0.04) than the frequency of the assignment to the phoneme [i:] (here 0.03).

The position-dependent frequencies show, however, that the frequency of the assignment of <i> to the phoneme [j] is low when <i> is located at the second position of the grapheme group <yi>. By contrast, the frequency of the assignment of <i> to the phoneme [i:] is high when <i> is located at the first position of the grapheme group <ie>.

This corrected assignment is also supported by the consideration of the position-dependent frequency of <e>. The frequency of the assignment of <e> to the phoneme [i:] is low when <e> is located in front of <l>. By contrast, the frequency of the assignment of <e> to the phoneme [i:] is high when <e> is located at the second position of the grapheme group <ie>.

The assignment can therefore be corrected in accordance with FIG. 6B.

After execution of the corrected assignment for each word of the lexicon, these corrected assignments are used to determine the transitional frequencies and the position-dependent frequencies. These are used in further assignments.

In order to determine the relative frequencies, only those assignments are taken into account in which the matrix entry for the last phoneme and the last grapheme (top right) overshoots a prescribed threshold value after execution of the multiplications outlined. This matrix entry corresponds to the product of the transitional frequencies along the best path. The magnitude of this product is therefore used as a criterion as to whether this path is to be accepted or not.

The method is executed in several iterations. In this case, the threshold value is high at the start and is reduced after each iteration. Consequently, at the start only those assignments are accepted which are correct with relative certainty. Since all frequencies are less than 1, the length of the word also enters indirectly into the product. The more factors the product has, the smaller it becomes. Thus, at the start it is predominantly the assignments of short words that are accepted. With short words, the probability of finding a wrong assignment is smaller than in the case of long ones.

The assignments in the case of which the product of the transitional frequencies has overshot the threshold value are used to obtain the new statistics. Even in the case of the first evaluation of the statistics thus obtained, most of the errors which have resulted from the one-to-one initialization of the frequencies have vanished. Moreover, it is also checked how frequently each grapheme-phoneme assignment has occurred. If the ratio undershoots a threshold value, this assignment is ignored, and thus not further used when the matrices are next filled up.

The result is an assignment of the graphemes to the phonemes for the entire lexicon. Furthermore, a list is obtained showing which phoneme or which phoneme group can be produced by which graphemes, for example [tS] in English by <ch>, <cz>, <c>, <tch>, <cc>, <t> and <che>.

The invention has been described in detail with particular reference to preferred embodiments thereof and examples, but it will be understood that variations and modifications can be effected within the spirit and scope of the invention.

What is claimed is:

1. A method for assigning phonemes to a lexicon of words using a dynamic time warping algorithm to phonetically transcribe the words by assigning phoneme sequences to grapheme sequences of the words, where the assignment of graphemes to phonemes within a word is corrected with aid of position-dependent relative frequencies including a frequency with which at least one grapheme at a specific position within a grapheme group is assigned to at least one phoneme.

2. The method as claimed in claim 1, wherein after execution of the assignment of graphemes to phonemes for each word of the lexicon, these assignments are used to determine the position-dependent relative frequency with which at least one of the following combination occur:

a phoneme produced by two or more graphemes,
two or more phonemes produced by a grapheme,
two or more graphemes assigned to a phoneme, and
a grapheme assigned to two or more phonemes.

3. A method for assigning phonemes to graphemes producing them in a lexicon having words (grapheme sequences) and corresponding associated phonetic transcription (phoneme sequences), comprising:

determining relative frequency with which the phonemes and the graphemes are assigned to one another for each assignment of phonemes and graphemes, creating for each word of the lexicon a two-dimensional matrix (incidence matrix), one index of which is given by the grapheme of the word, and the second index of which is given by the phoneme of the word, selecting the relative frequencies belonging to the respective phoneme-grapheme pair determined as entries of the matrix, logically combining each matrix entry with aid of a mathematical operation with the extreme value of the following three preceding matrix entries:

the entry for the same phoneme and the preceding grapheme in the word, the entry for the preceding phoneme and the same grapheme in the word, and the entry for the preceding phoneme and the preceding grapheme in the word, using the first grapheme and the first phoneme of the word as the starting point in the mathematical operation, and using the modified entries of the matrix in determining the extreme values, the modified entries being respectively yielded from the mathematical operation, determining which of the three preceding matrix entries was extreme to thereby determine a direction for this matrix entry, defining the direction determined for the matrix entry, starting from the matrix entry for the last phoneme and the last grapheme, and proceeding along a path through the matrix up to the matrix entry for the first phoneme and the first grapheme, and using the matrix elements along the path to define the assignment of graphemes to phonemes of the word, where the assignment of graphemes to phonemes within a word is corrected with aid of position-dependent relative frequencies including a frequency with which at least one grapheme at a specific position within a grapheme group is assigned to at least one phoneme.

4. The method as claimed in claim 3, wherein the relative frequencies are determined by selecting words from the lexicon in the case of which the number of the graphemes and the number of the phonemes coincide, for the selected words, the graphemes and phonemes are assigned to one another in the sequence of the specification of their graphemes and phonemes in the lexicon.

5. The method as claimed in claim 3, wherein after execution of the assignment of graphemes to phonemes for each word of the lexicon, these assignments are used to determine the position-dependent relative frequency with which at least one of the following combinations occur:

a phoneme produced by two or more graphemes, two or more phonemes produced by a grapheme, two or more graphemes assigned to a phoneme, and a grapheme assigned to two or more phonemes.

6. The method as claimed in claim 1 or 3, wherein after assigning graphemes to phonemes for selected words in the sequence of the specification, for each word of the lexicon, the corrected assignments are used to recalculate the position-dependent relative frequency with which a phoneme is produced by two or more graphemes, or two or more phonemes are produced by a grapheme; and the recalculated position dependent relative frequencies are used to again assign graphemes to phonemes for selected words in the sequence of the specification.

7. The method as claimed in claim 6, wherein each matrix is combined with a multiplication mathematical operation, and in order to determine the relative frequencies, only those assignments are taken into account in which the matrix entry for the last phoneme and the last grapheme exceeds a prescribed threshold value after multiplication of matrices.

8. The method as claimed in claim 3, wherein the matrix entry for the first phoneme and the first grapheme of each word is set to 1;

the matrix entry for the last phoneme and the last grapheme of each word is set to 1;

the matrix entry for the first phoneme and the last grapheme of each word is set to 0; and the matrix entry of the last phoneme and the first grapheme of each word is set to 0.

9. The method as claimed in claim 3, wherein if in the determination of the maximum value of the three preceding matrix entries the matrix entry for the preceding phoneme and the preceding grapheme in the word and one of the other two entries are of equal magnitude, the matrix entry for the preceding phoneme and the preceding grapheme in the word is regarded as a maximum.

10. A computer system of assigning phonemes to a lexicon of words, comprising:

a storage device for storing a computer program on a storage medium; and a processing unit for loading the computer program from the storage device and for executing the computer program so as to use a dynamic time warping algorithm to phonetically transcribe the words by assigning phoneme sequences to grapheme sequences of the words, wherein the assignment of graphemes to phonemes within a word is corrected with aid of position-dependent relative frequencies including a frequency with which at least one grapheme at a specific position within a grapheme group is assigned to at least one phoneme.

11. A computer readable medium storing a program for controlling a computer to perform a method of assigning phonemes to the graphemes producing them in a lexicon having words (grapheme sequences) and their associated phonetic transcription (phoneme sequences), comprising:

determining relative frequency with which phonemes and graphemes are assigned to one another for each assignment of phonemes and graphemes, creating for each word of the lexicon a two-dimensional matrix (incidence matrix), one index of which is given by the grapheme of the word, and the second index of which is given by the phoneme of the word, selecting the relative frequencies belonging to a respective phoneme-grapheme pair as entries of the matrix, logically combining each matrix entry with the aid of a mathematical operation with the extreme value of the following three preceding matrix entries:

the entry for the same phoneme and the preceding grapheme in the word, the entry for the preceding phoneme and the same grapheme in the word, and the entry for the preceding phoneme and the preceding grapheme in the word, using the first grapheme and the first phoneme of the word as the starting point in the mathematical operation, and using the modified entries of the matrix in determining the extreme values, the modified entries being respectively yielded from the mathematical operation, determining which of the three preceding matrix entries was extreme to thereby determine a direction for this matrix entry, defining the direction determined for the matrix entry, starting from the matrix entry for the last phoneme and the last grapheme, and proceeding along a path through the matrix up to the matrix entry for the first phoneme and the first grapheme, and using the matrix elements along the path to define the assignment of graphemes to phonemes of the word, where the assignment of graphemes to phonemes within a word is corrected with the aid of position-dependent relative frequencies including a frequency with which at least one grapheme at a specific position within a grapheme group is assigned to at least one phoneme.

* * * * *